United States Patent [19]

Markööö et al.

[11] 3,942,959

[45] Mar. 9, 1976

[54] MULTILAYERED FLEXIBLE ABRASIVE CONTAINING A LAYER OF ELECTROCONDUCTIVE MATERIAL

[75] Inventors: Eric L. Markööö, Markaryd; Tore G. H. Strand, Naasjo; Thorsten W. Sandell, Markaryd, all of Sweden

[73] Assignee: Fabriksaktiebolaget EKA, Sweden

[22] Filed: Aug. 13, 1973

[21] Appl. No.: 387,748

Related U.S. Application Data

[63] Continuation-in-part of Ser. No. 162,938, July 15, 1971, abandoned, which is a continuation-in-part of Ser. No. 774,340, Nov. 8, 1968, abandoned.

[30] Foreign Application Priority Data

| | | |
|---|---|---|
| Dec. 22, 1967 | Sweden | 17777/67 |
| Dec. 10, 1968 | Belgium | 67733 |
| Dec. 16, 1968 | United Kingdom | 59616/68 |
| Dec. 20, 1968 | United Kingdom | 9347/68 |
| Dec. 19, 1968 | Italy | 25325/68 |
| Dec. 18, 1968 | Canada | 38123 |
| Dec. 19, 1968 | Canada | 154891 |

[52] U.S. Cl. ..... 51/295; 51/297; 51/298 A; 51/301

[51] Int. Cl.[2] ..... B24D 11/00

[58] Field of Search ..... 51/295, 298, 299, 297, 51/301

[56] References Cited

UNITED STATES PATENTS

| | | | |
|---|---|---|---|
| 3,030,251 | 4/1962 | Bore et al. | 51/295 |
| 3,168,387 | 2/1965 | Adams | 51/295 |
| 3,256,076 | 6/1966 | Duwell et al. | 51/298 |
| 3,413,106 | 11/1968 | Argiro | 51/295 |
| 3,619,150 | 11/1971 | Rinker | 51/298 |

*Primary Examiner*—Donald J. Arnold

[57] ABSTRACT

The accumulation of electrostatic charges in an abrasive article having a flexible backing sheet, a layer of adhesive and abrasive grains embedded in the adhesive is prevented by incorporating an electroconductive metal pigment or ionizable salt in an inner layer of the article and sandwiching this layer between two layers of substantially lower electroconductance so as to insulate the inner layer.

14 Claims, 3 Drawing Figures

Figure 1:
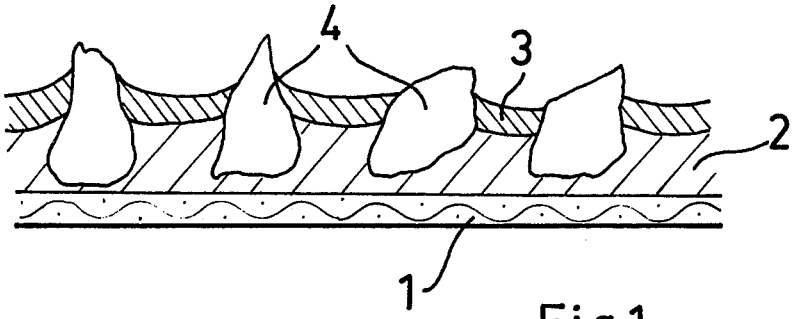

INVENTORS
ERIC L. MARKÖE
TORE G. H. STRAND
TORSTEN W. SANDELL
By Jacobs & Jacobs

MULTILAYERED FLEXIBLE ABRASIVE CONTAINING A LAYER OF ELECTROCONDUCTIVE MATERIAL

CROSS REFERENCE

This is a continuation-in-part of Ser. No. 162,938, filed July 15, 1971, now abandoned, which in turn is a continuation-in-part of Ser. No. 774,340, filed Nov. 8, 1968, now abandoned.

BACKGROUND OF THE INVENTION

When abrading or polishing wood, synthetic resins and some metals and alloys, notably light metals and light metal alloys, using conventional abrasive articles, such as abrasive belts, electrostatic charges are accumulated on the belt surface, and on the working piece itself. Typically, the belt may accumulate a positive charge of up to 7500 v/cm. while the wood being worked may accumulate a charge of up to −7500 v/cm. These charges have a detrimental, sometimes harmful, effect. Thus they tend to repel the particles of abraded material from some regions of the abrading machine, and from the abrasive belt itself, and these particles become suspended in the air. A large amount of the abraded particles will not be removed by the normal vacuum device downstream from the working piece. Apart from the nuisance of having the articles forming a layer of dust over the entire workshop, they also present a health and fire hazard. The dust can also adhere to the piece being worked, thereby necessitating an extensive cleaning prior to finishing.

Electrostatic charges also seem to be responsible for increased clogging of the abrasive surface. It has been shown that if the electrostatic charges can be eliminated, a grinding belt will have its lifetime, i.e., its useful time before clogging, increased at least by 50 or 100 percent, all other circumstances being equal. Electrostatic charges have been directly responsible on some occasions for accidents at a belt grinding machine where the work piece is handled manually. Less experienced workers in some cases have had serious accidents when suddenly exposed to a discharge, even if aware that such a discharge might occur.

Attempts have, of course, been made to eliminate or reduce the surface charges. As far as applicant is aware none of these attempts have been very successful.

It has been suggested to provide one or both sides of an abrasive, flexible article with a layer of conductive particles to increase heat conductivity or to reduce friction. These abrasive articles are quite effective in this respect for abrading and polishing steel and metals, but less so for treating synthetic resins, and non-effective or even harmful for the wood.

It is a common practice to use grounded metal whiskers to dissipate electrostatic charges from various moving machine parts. This has also been tried for abrasive belt grinders but with little or no success. The reason for the failure is not fully understood, but it may be assumed that the explanation lies in the structure of the abrasive surface itself. Thus the whiskers will only be able to contact the peaks of the abrasive grains, and therefore each successive row of whiskers will only be effective to discharge a small fraction of the total surface charge. Since the whiskers will of course be worn out by the abrasive surface, the use of many successive rows of whiskers is technically, as well as economically, unattractive. Another factor which prohibits the use of metal whiskers contacting the abrasive surface in belt grinders for woodwork is that abraded metal from the whiskers can contaminate the wood. The metal particles themselves would, of course, be small enough so as to be not noticeable, but many of the dyes used for coloring wood will react with metal particles to produce discoloration and spots on the treated surface.

As mentioned above, it has been proposed to provide an abrasive belt on either or both sides with a layer of metal particles in order to improve heat transfer, reduce clogging, and to reduce friction sbetween the back and the support. Such a layer or layers, applied directly on the abrasive grits or on the back, may be effective for abrading steel and some metals, but have proved able to only temporarily reduce the electrostatic surface charges on a grinding belt used for treating wood or synthetic resins and only to a small extent. Moreover, it is not permissible, as a rule, to apply metal particles to the abrasive side of grinding belts used for wood, since the particles may deposit on and contaminate the surface of the wood, as discussed above in connection with metal whiskers. Applying metal to the back of the grinding belt reduces the electrastatic charge build-up for a short time but only for a small fraction of the lifetime of the grinding belt. At least in some cases, a metalized back considerably increases the working temperature of the grinding belt, probably due to contamination with wood dust, to the extent that the backing member, which usually is made of a strong paper material, is charred and destroyed.

Despite serious attempts on behalf of many workers, the problem of eliminating an electrostatic charge built-up on the surface of conventional grinding belts used in workwodking has remained unsolved until now.

SUMMARY OF THE INVENTION

It has been found that in a conventional multilayered abrasive article of the kind normally used for grinding or polishing wood, in particular of the endless, flexible belt type, the electrostatic surface charge may be reduced from a typical voltage of 10 kV or higher to a residue voltage of about 50 v or lower.

This can be accomplished by including in the abrasive article, at any level thereof except an outer layer, a layer of a material or compound having good electrical conduction properties. The layer of conducting material or compound does not have to be "conductive" in the usual sense of the word; i.e., it does not have to be a metallic conductor but may be, for example, metallic pigment or an electrolytically ionizable salt. On both sides of this layer will be an insulating layer of significantly lower electroconductivity. It should be pointed out that it is very difficult to determine with any degree of accuracy what the actual conductivity of any given material will be, especially for electrically polarizable materials. The materials exemplified in the specifications have given excellent results. These materials, however, are important only insofar as they impart the necessary electroconductivities to the respective layers and numerous other materials can obviously be substituted to achieve the same result. Generally the conductive layer will have a resistance of less than one megohm, typically about $1 \times 10^{-2}$ to $1 \times 10^{-3}$ megohms while the insulating layers will have resistances in excess of one megohm, typically $1 \times 10^{3}$ megohms, as measured in situ with two-point contact electrodes opened approximately 10 mm apart. It is also difficult to measure the surface conductivity of the layer of abrasive particles or the material of the smooth back surface in actual use, since they differ from sample to sample in terms of curing and storage times, air moisture content, and the like. Tests have been carried out to determine the relative conductivity of the abrasive layer and the backing member, as compared with the conductivity of the conducting layer as defined in the specification, using an apparatus normally employed to determine the moisture content of paper or fabric and these tests seem to indicate a difference in conductivity of at least two orders of magnitude. These tests, of necessity, consider only rough estimates and the findings so far are not conclusive.

As mentioned, it seems to be immaterial to the results obtained whether the conductive layer consists of a metal pigment layer or an ionizable substance, such as a salt. This is rather surprising since it would be expected that they would behave differently to some degree.

Another curious fact is that measurements of the magnitude of the electrostatic field surrounding an ordinary grinding belt of conventional design points to a charge differential between opposite surfaces of the belt, which is of the order of two or more times the break-down voltage for the material. The probable explanation for this is that the break-down voltage is normally determined using a high voltage source capable of delivering a rather substantial current, at least of the order of several microamperes, and that the measuring electrodes also have a condiserable capacitance, at least of the order of 1 to 5 pF. At a voltage of the order of 10 kV, the energy is thus sufficient to initiate an avalance ionization of the material of the sample, ultimately leading to a thermal punch-through. When the electrostatic charges are generated by friction, on the other hand, the energies available appear to be insufficient to bring about any avalanche effect since the high surface resistance of the material prohibits any considerable current flow between adjacent surface points of the material. Thus strong polarization is obtained and the charge is free to exceed the normal punchthrough voltage.

Introducing an easily ionizable material such as, for example, a metal salt or similar compound in the region between the two surfaces or two insulating layers drastically changes the picture. Although not wishing to be bound by any theory, it is assumed with some confidence that the potential energy of the electrostatic field is rapidly converted into kinetic energy on the part of the ions, and that this forms short circuit paths between the opposite surfaces of the material. It is not completely understood why a metal pigment layer produces the same result, and it should be pointed out that the above considerations are more speculative than explanatory of the mechanism involved. In every case tried, however, a layer of any electrically conducting material, be it metal pigments, salts, or the like, located anywhere in the structure of a grinding belt, except directly over the abrasive grits or directly on the back, all but completely eliminates any build-up of electrostatic charges on the grinding belt surfaces.

Accordingly it is a primary object of the present invention to improve abrasive articles having a flexible backing member and abrasive grits embedded and held in at least one layer of adhesive on one side of the flexible backing member, the improvement, which comprises providing at least one layer of electroconductive material integral with said abrasive article, and opposite insulating or semi-insulating layers on either side of said layer of electroconductive material.

It is another object of the present invention to provide an abrasive article of the kind mentioned which the layer of electroconductive material is included in the material of said backing member.

It is still another object of the present invention to provide an abrasive article of the kind mentioned in which the layer of electroconductive material is included in at least one layer of the adhesive.

It is a further object of the present invention to provide an abrasive article of the kind methioned in which the layer of electroconductive material is applied on either side of said backing member.

It is still a further object of the present invention to provide an abrasive article of the kind mentioned in which the electrocondictive material is a metal pigment or an ionizable compound.

These and further objects and advantages of the present invention will become more apparent upon reference to the following specification and claims and the appended drawings, Referring to FIG. 1 of the drawings, there is shown, in cross section, and in enlarged scale, a conventional, flexible multilayered abrasive article, e.g. an endless abrasive belt. The belt comprises a flexible backing member 1 of strong paper material or made from a suitable fabric, such as cotton. On one side of the backing member 1 there is a layer 2 of a suitable adhesive, which is conventional and well known as, for example, synthetic or animal glue, and in which the abrasive grains 4 are anchored. A second layer of adhesive 3 generally fills the space between the grains 4, except for their sharp abrasive points, which are exposed. Such abrasive articles and the method of their manufacture, as well as the materials employed are well known in the art. Individual belts may depart in one or more respects from what is shown in FIG. 1 but it should be understood that such minor changes per se do not prevent the teachings of the present invention from being applied to such articles to effectively eliminate surface charge build-up, as will be evident from the following detailed description.

The abrasive article shown in cross section in FIG. 1 and described above may have its tendency to generate and accumulate electrostatic charges considerably improved simply by including in the layer 2 of glue a suitable material or compound which increases the electric conductivity of this layer. Almost any metal pigment will be useful in this respect as, for example, an aluminum pigment. Similarly a number of different metal salts, such as aluminum chloride, included in the material will serve the same purpose. Other materials which are suitable include the metals or metal alloys of iron, nickel, copper, zinc, silver, tin, lead, and the like, as well as readily ionizable salts and complexes of those metals and salts and/or complexes of sodium, potassium, cadmium and the like.

Tests have shown that such a conductive layer in an abrasive belt will reduce the electrostatic field around the belt due to electrostatic surface charges to one per cent, or less, of the value obtained with an ordinary abrasive belt under identical circumstances. It would therefore seem that such a conducting layer placed between two layers of essentially non-conducting insulating material, in this case the backing member 1 and the layer comprising the glue 3 and grains 4, essentially provents a build-up of electrostatic charges. The exact mechanism by which the charge build-up is prevented and/or by which the charge is dissipated or possibly converted into heat has, as far as the inventors are aware, never been described with connection to abrasive articles, such as grinding belts, nor been suggested as a remedy for the well known disadvantages in grinding or polishing wood with conventional abrasive sheet material. It is possible that the explanation for the mechanism can be found in publications relating to electrostatics, but a search of standard textbooks on the subject has not produced any evidence for this assumption.

Figure 2:
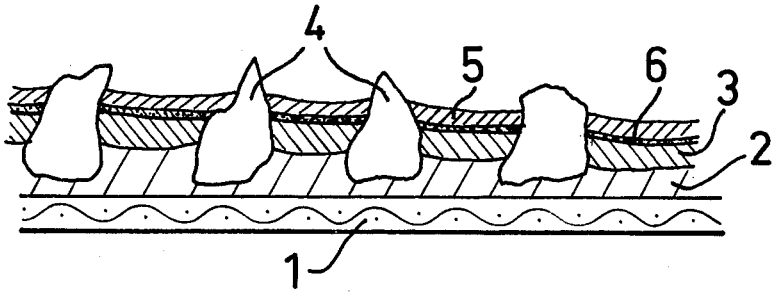

Referring to FIG. 2 in the drawings there is shown, in cross section, a flexible abrasive article, e.g. an abrasive belt, according to the invention. As in FIG. 1, a backing member 1 is covered on one side with a layer of adhesive 2 in which abrasive grains 4 are embedded or anchored with a second layer 3 of glue partly filling the space between the grains, leaving the abrading points free. So far the abrasive is of conventional design.

Over the layer 3 of glue, however, there is shown a further layer 6 of a material having comparatively high electroconductivity. This layer can comprise metallic particles, metal pigments or metal salts or a combination of these, as further described, in the Examples of this specification. Due to the nature of the invention it is impossible to present an exhaustive list of materials and/or compounds that can be employed in the layer of high electroconductivity. One skilled in the art need only select a material or compound for this layer meeting the following criteria:

1. The material or compound should have essentially similar mechanical properties as the glue or adhesive normally used for anchoring the abrasive grains; i.e. when dried or cured it can be somewhat elastic but should preferably crack freely and have no tendency of peeling from its bond to layer 3.
2. The material or compound should have a comparatively high electric conductance but need not be anything like a metallic conductor. As a matter of fact, metallic and ionic conductors seem to work equally well in meeting the object of the invention.
3. The material or compound should have no adverse chemical effects on the glue and other materials of the abrasive article with which it may come in contact.
4. The material or compound should preferrably be cheap and easy to apply in the same manner with which glue is applied to the abrasive article in its manufacture.
5. The material or compound should preferrably require a short curing time.

Other requirements would be determined on the specific abrasive to which the teachings of the invention are to be applied and such considerations should be obvious to anyone skilled in the art.

The conductive layer 6 is covered with a protective layer 5 of a material of compound having comparatively less electric conductivity. It is usually sufficient to use for layer 5 the same glue as used for anchoring the abrasive grains 4, in the layers 2 and 3, without, of course, any additives increasing conductivity. The designer has a wide latitude in choosing materials or compounds which otherwise satisfy the obvious and unrelated mechanical requirements.

Figure 3:
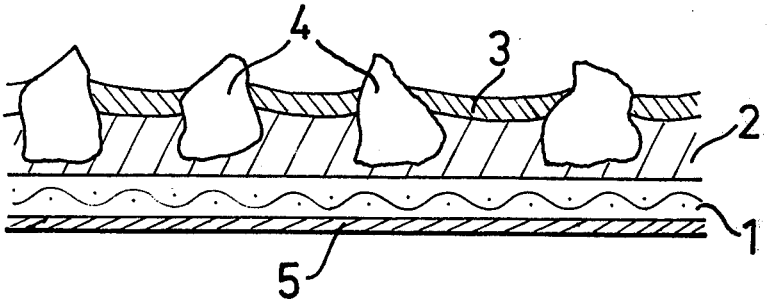

Referring finally to FIG. 3, there is shown, in the same manner as in FIGS. 1 and 2, a backing member 1 on one side provided with glue layers 2 and 3 for anchoring abrasive grains 4 to said side.

The backing member 1, however, which may be manufactured from strong paper or fabric, or from any other strong, flexible and porous material, is covered on the back with an additional layer 5. In this case the backing member is impregnated with the metal salt or ionizable compound, thereby rendering the backing member itself the high conductivity layer. The impregnation can be performed either when the backing member is manufactured or thereafter. It can also be carried out when the layers of glue and abrasive grit have been applied.

In order for the conductive layer to have the desired effect, however, it is essential that it does not directly contact the support member employed. This arrangement seems to cause excessive heating and a rapid decrease in the anti-electrostatic effect. Why this is so is not completely understood, in particular since some workers have claimed an improved heat transfer if the backing member is provided with a metallized back. We have carried out some tests, however, to this effect, which are described hereafter.

In the embodiment shown in FIG. 3, according to the invention, an additional layer 5 on the back of the backing member 1 is provided. This layer can be of any suitable material having significantly lower electric conductivity. Advantageously, the layer also has a lower coefficient of friction, with respect to the material of the machine support which is located opposite the zone in which the actual grinding is carried out. Such materials are for example artificial or natural resins, mineral oils or waxes, stearates or similar fatty substances, silicones and other ones, well known to anyone skilled in the art. The only requirement that the invention imposes on the material or substance is that it should have a significantly lower electroconductivity.

The following specific examples will serve to further typify the nature of the invention, but should not be considered limiting the scope of the invention, the invention being defined only by the appended claims.

EXAMPLE 1 — Comparative

A mixture (A) was prepared adding:

70 parts by weight of aluminum particles to;

30 parts by weight of an aqueous solution of animal glue.

The aluminum particles had an average cross section smaller than 0.04 millimeters and an actual size analysis showed only traces of particles larger than 0.16 mm, 0.5 percent of the particles ranging from 0.16 to 0.125 mm, 10 to 20 percent in the range from 0.125 to 0.04 mm, and the rest, 80–90 percent, being smaller than 0.04 mm in cross section.

The aqueous solution of glue consisted of a solution of 3 percent by weight of solid animal glue dissolved in water.

The aqueous mixture was distributed uniformly over the abrasive surface of a flexible belt, of the kind generally shown and described with reference to FIG. 1. The amount used was from 75 to 100 g. per square meter, and the abrasive belt thus treated was dried and cured at elevated temperature. It has been suggested in the prior art that such a treatment would be beneficial with respect to the abrasive properties of the belt. In order to test the validity of this assemption with respect to woodwork, the following test was carried out.

When completely cured, the belt was placed in a test grinding machine which was operated at normal belt speed, i.e. about 25 meters per second, and at normal grinding pressure, i.e. about 1000 mm. water column. The material in the working piece was beech, and the support located on the opposite side of the grinding belt had a surface of tiny glass beads.

The measuring probe of an electrostatic voltmeter was placed about 10 mm. from the surface of the grinding belt. When the belt was running at the indicated speed, no electrostatic build-up could initially be detected. Also when the grinding started there was at first no indication of any electrostatic charge, and the ground ground-off material initially followed the slipstream along the surface of the abrasive belt without any appreciable dispersion.

A number of successive tests were made and in every instance, it took only a 5 to 15 minutes for the electrostatic charge to climb to several kilovolts. The increase in charge was accompanied by an increasing dispersion of the ground off particles in the air.

Thus the metallized layer on the abrasive surface had no lasting effect and after 15 to 30 minutes of work, this grinding belt behaved no better than a completely untreated belt, as far as the practical results were concerned. The actual electrostatic field, however, was somwhat lower in the case where the grinding belt was provided with the metallized layer than for a non-treated grinding belt, but as far as woodwork is concerned this had no practical advantages whatsoever.

EXAMPLE 2 — Present Invention

The abrasive belt was treated as in Example 1, but over the layer of aluminum particles and glue, a second layer was uniformly distributed. This second layer was obtained by preparing a mixture (*b*) by dissolving:

15 parts by weight of zinc stearate in;
85 parts by weight of an aqueous solution of animal glue, similar to the one used in Example 1, mixture (A).

The mixture B was used in an amount of from 100 to 200 g per square meter, and was completely dryed and cured at elevated temperature.

Tests analogous to the ones described in Example 1 were carried out on the abrasive belt thus obtained, and in this case the maximum electrostatic charge build-up was of the order of 50 volts, with no tendency to increase during the normal life of the abrasive belt, i.e., during the time of several working days.

An abrasive belt treated with only solution B is no better in actual use, as far as the anti-electrostatic properties are concerned, than an untreated belt or belt treated only with solution A.

Electrostatic charges of the order of 50 volts have no detrimental effects whatsoever on the disperson of dust. Moreover, even this rather low electrostatic charge appeared to occur only in very dry environments. In many tests, no charge whatsoever could be measured with the abrasive article of the present invention.

EXAMPLE 3 — Comparative

The abrasive belt was treated as in Example 1 except that the treatment was made on the backside. Results were essentially similar in all respects to the ones related in Example 1; i.e., no lasting anti-electrostatic effect was observed.

EXAMPLE 4 — Present Invention

The abrasive belt was treated as in Example 2 (application of mixture A as in Example 1, followed by application of mixture B), but the treatment was made on the back of the belt. Very good results, in all respects similar to the ones related in Example 2, were obtained.

EXAMPLE 5 — Present Invention

The flexible abrasive belt was manufactured in the usual manner but 35 parts by weight of aluminum chloride were added to 100 parts by weight of the aqueous solution of animal glue normally used for anchoring the abrasive grains to one side of the flexible backing member. The mixture was applied over one surface in the wet glue. After drying and curing a second layer of glue was distributed over the first-mentioned layer and over the grains, which second layer consisted of an ordinary solution of animal glue in water; i.e., without any conductivity increasing additives. After drying and curing, the abrasive belt was tested as described in Example 1. Essentially the same advantageous results were obtained, with respect to elimination of electrostatic surface charge build-up, as related in Example 2.

EXAMPLE 6 — Present Invention

A flexible abrasive belt having a backing member of strong paper material was treated on the back with a mixture (D) of 30 parts by weight of aluminum chloride
100 parts by weight of water, and
30 parts by weight of a paraffin oil dispursed in the water.

After drying and curing, tests as described in Example 1 were carried out. The same reduction or elimination of the electrostatic charge build-up observed in Example 2 was obtained. The aluminum chloride solution penetrates into the backing member where it forms a region having comparatively high conductance, whereas the paraffin oil remains on and in the surface layer of the backing member where it forms a substantially nonconductive cover.

The experiments related above are by no means all that have been tried in order to improve the anti-electrostatic properties of abrasive articles within the scope of the present invention, with essentially the same, excellent results, but the examples given should enable anyone skilled in the art to work the invention, chosing such methods, materials and compounds as the specific application requires. The present invention can be embodied in other specific forms without departing from the spirit or essential characteristics thereof. The present embodiments are therefore to be considered in all respects as illustrative and not restrictive, the scope of the invention being indicated by the appended claims and all changes which come within the range of equivalency of the claims are therefore to be embraced therein.

What is claimed is:

1. A multilayered abrasive article comprising a flexible backing member layer, at least one adhesive layer of synthetic or animal glue on one face of the backing member layer, and abrasive grains embedded in the adhesive layer, the improvement resulting in the reduction of the accumulation during use of electrostatic surface charges comprising (1) the presence of an inner layer in said abrasive article of sufficient electroconductive material selected from the group consisting of metals, metal alloys, metal pigments, metal salts and metal complexes to render said inner layer significantly more conductive to electrostatic charges than said inner layer would be without said electroconductive material, and (2) on each of the two faces of said inner layer an insulating layer of material having significantly lower electroconductivity than said electroconductive material, said two insulating layers being of the same or different material.

2. The improved abrasive article as defined in claim 1 wherein said ashesive layer on one face of said flexible backing member layer also serves as one of said insulating layers, said electroconductive material is impregnated in said flexible backing member layer, and said abrasive article includes a further layer of low electroconductive material on the other face of said backing member layer, said further layer constituting the second of said insulating layers.

3. The improved abrasive article as defined in claim 1 wherein the inner layer containing the electroconductive material is adjacent to said backing member layer, and said backing member layer constitutes one of said insulating layers.

4. The improved abrasive article as defined in claim 3 wherein said electroconductive material is in said adhesive layer, said flexible backing member layer serving as one of said insulating layers, and a second outer layer of adhesive serving as said second insulating layer is present on said first adhesive layer.

5. The improved abrasive article as defined in claim 3 wherein said inner layer containing said electroconductive material is adjacent to the face of said backing member layer opposite said adhesive layer, and said second insulating layer is present as a separate layer on the other side of said inner layer.

6. The improved abrasive article as defined in claim 1 wherein said inner layer and said two insulating layers are present as separate layers over the adhesive layer on the abrasive side of said article.

7. The improved abrasive article as defined in claim 1 wherein said electroconductive material is a metal, or metal pigment.

8. The improved abrasive article as defined in claim 7 wherein said electroconductive material is a metal pigment.

9. The improved abrasive article as defined in claim 1 wherein said electroconductive material is a metal salt.

10. The improved abrasive article as defined in claim 9 wherein said metal salt is a salt of aluminum, iron, nickel, copper, zinc, silver, tin, lead, sodium, potassium or calcium.

11. The improved abrasive article as defined in claim 7 wherein said electroconductive material is a metal.

12. The improved abrasive article as defined in claim 11 wherein said metal is aluminum, iron, nickel, copper, zinc, silver, tin or lead.

13. The improved abrasive article as defined in claim 1 wherein the resistance of said inner layer is less than 1 megohm and the resistances of said insulating layers are each greater than 1 megohm.

14. The improved abrasive article as defined in claim 13 wherein the resistance of said inner layer is less than about $1 \times 10^{-2}$ megohms and the resistance of said insulating layer is greater than $1 \times 10^{3}$ megohms.

* * * * *

UNITED STATES PATENT AND TRADEMARK OFFICE

CERTIFICATE OF CORRECTION

PATENT NO. : 3,942,959

DATED : March 9, 1976

INVENTOR(S) : Eric L. Markoo et al

It is certified that error appears in the above-identified patent and that said Letters Patent are hereby corrected as shown below:

Under the heading "Foreign Application Priority Data", cancel all applications except "December 22, 1967, Sweden 17777/67".

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*